US005775012A

United States Patent [19]

Hockensmith

[11] Patent Number: 5,775,012

[45] Date of Patent: Jul. 7, 1998

[54] UTILITY BLADE HITCHED TO A VEHICLE

[76] Inventor: William L. Hockensmith, H.C. 81, Box 76, Romney, W. Va. 26757

[21] Appl. No.: 861,059

[22] Filed: May 21, 1997

[51] Int. Cl.[6] ..... E01H 5/06

[52] U.S. Cl. ..... 37/270; 37/383; 37/232; 172/834; 172/298

[58] Field of Search ..... 37/270, 271, 232, 37/383, 903; 172/244, 816, 834, 298, 387

[56] References Cited

U.S. PATENT DOCUMENTS

| | | | |
|---|---|---|---|
| 1,082,222 | 12/1913 | Benge | 172/192 |
| 1,894,871 | 1/1933 | Iverson | 37/383 |
| 2,713,220 | 7/1955 | Muenchow | 37/232 X |
| 4,109,729 | 8/1978 | Kaercher, Jr. | 172/387 X |
| 4,369,590 | 1/1983 | Miller | 37/371 X |
| 4,521,980 | 6/1985 | Solaja | 37/903 X |
| 4,709,492 | 12/1987 | Watson | 37/232 |
| 4,754,562 | 7/1988 | McGarrah et al. | 37/232 |
| 4,867,606 | 9/1989 | Wright | 37/904 X |

*Primary Examiner*—Tamara L. Graysay
*Assistant Examiner*—Thomas A. Beach
*Attorney, Agent, or Firm*—William F. Hamrock

[57] ABSTRACT

A hitch adjustable rear blade hitched to the back of a tractor for earth grading operations. The blade having an elongated cylindrical skid releasably mounted to the back of the blade adjacent the leading edge of the blade and a pair of spaced apart stabilizer springs adjustably mounted to the front of the blade holding the blade in tensional position. A front blade having the elongated cylindrical skid releasably mounted is also disclosed.

15 Claims, 8 Drawing Sheets

UTILITY BLADE HITCHED TO A VEHICLE

BACKGROUND OF THE INVENTION

1. Field of the Invention

The invention pertains to a utility front blade attached to the front of a vehicle and to a rear blade hitched to the back of a tractor for earth grading or snow removal operations and, in particular, to the rear blade supported by horizontally oriented elongate cylindrical skid adjacent the blade's lower leading edge which controls the up and down movement of the blade and supported by stabilizer springs at the blade's upper portion which provide tensional bracing adjustment of the blade to control the back and forth movement of the blade.

2. Description of the Prior Art

Utility rear blades, hereinafter referred to as blades, for earth grading and snow removal operations are known. Generally, the blade includes an inwardly curved longitudinal blade body, often referred to as the moldboard, and a bottom blade portion having a leading edge which digs into the material being graded or plowed. The blade is secured to the supporting structure, often referred to as the mainframe, through which the blade is attached to the rear of a tractor by the tractor's three point hitch. The problem with this structure is that it does not work well generally when working on roads, especially when the roads are covered with loose stone or gravel surfaces. When working on these roads, the stones and gravel have a tendency to accumulate on the outer edges and on the center portions of the road so that little protection is provided to the road surface. Also, indented tire tracks are generally formed on the road surface by the on-going traffic resulting in low areas in the road w here the t ire tracks are formed.

Heretofore, the conventional blade has been modified with a pair of spaced apart rectangular supports or feet adjacent the bottom of the blade's leading edge, each support located slightly inwardly from the outer edges of the blade. These conventional supports are used to control the height of the leading edge of the blade slightly above the road surface so that the leading edge rides above the stones and gravel on the road surface. However, a disadvantage in using these supports is that the supports fall into and travel within these low lying tire tracks causing the leading edge of the blade attachment to fall close to the road surface or to come in contact therewith while pushing the stones and gravel to the outside and to the center of the road while increasing the depth of the tire tracks.

Another problem with the blade structure results when the yoke pin which secures the upper surface of the blade to the mainframe and to the tractor is removed to allow the blade to tilt. The blade is allowed to tilt so that it can follow the contour of the surface in working over uneven surfaces. However, when the tilted blade is held at its nonworking raised position off the ground, one end of the unbalanced blade has a tendency to move upwardly and the opposite end is to move downwardly allowing the lower end of the leading edge to drag into the ground and possibly damaging the entire blade and the underlying surface.

A further problem with the blade structure occurs when the blade is rotated to a new horizontal position by removing securing pins and securing the blade in the new position by replacing the securing pins. One end of the blade then rotates towards the rear of the tractor and the opposite end rotates away from the tractor.

As previously discussed, there are problems in the prior art in providing a blade which will operate efficiently on roads having stone and gravel surfaces and on other surfaces.

Also, the uncontrolled up and down movement of the blade and the forward and rearward rotation of the blade prevent efficient grading and plowing operation. Prior United States patents relate to various types of rearwardly attached earth working equipment. However, none of patents solve the problems associated with utility blades attached to the mainframe and tractor as discussed.

U.S. Pat. No. 1,126,805 is an example of a complicated prior art Combination Drag, Grader and Ditcher having an angle iron fixedly bolted to the rear face of the drag blade. However, the complicated angle iron structure would not work with the blades of the present invention attached to a three point hitch.

SUMMARY OF THE INVENTION

The present invention solves many of the problems and shortcomings of the prior art by providing an elongated cylindrical skid releasably attached to the blade adjacent the leading edge, and a pair of stabilizer springs tensionally securing the blade to the mainframe when the yoke pin has been removed and securing pins resecured to the mainframe. The skid supports the blade at a set level position and at a preset height position. In this manner the blade can be set at a higher level than the base of the skid allowing the leading edges of the blade to skim over the stones and gravel while pushing the plowed debris, stones or snow to the outside edge of the blade and to the side of the road. Also, the skid can be set at a low position so as to draw debris and stones into the low lying areas such as tire tracks or other predetermined area. Likewise, the leading edge and blade can be lowered for pushing the stones and debris into the low lying areas.

Simultaneously, while the skid is set in its working position moving along the ground or with the blade and skid at the raised nonworking position, the stabilizer springs tensionally control the horizontal position of the blade while restraining the upward and downward movement. Accordingly, the skid and rear blade firmly and resiliently follow the contour of the ground or worked surface by firmly engaging the undersurface and by allowing resilient movement of the blade to slide over obstacles. Also, when the rear blade is attached to the tractor in the nonworking raised position, the stabilizer springs firmly secure the blade to the mainframe so that there is no up and down movement of the blade preventing any damage to the rear blade from tilting and encountering the ground.

BRIEF DESCRIPTION OF THE DRAWINGS

The present invention will be more fully understood by reference to the following detailed description thereof, when read in conjunction with the drawings, wherein like reference numerals refer to like elements.

DESCRIPTION OF THE PREFERRED EMBODIMENTS

Figure 1:
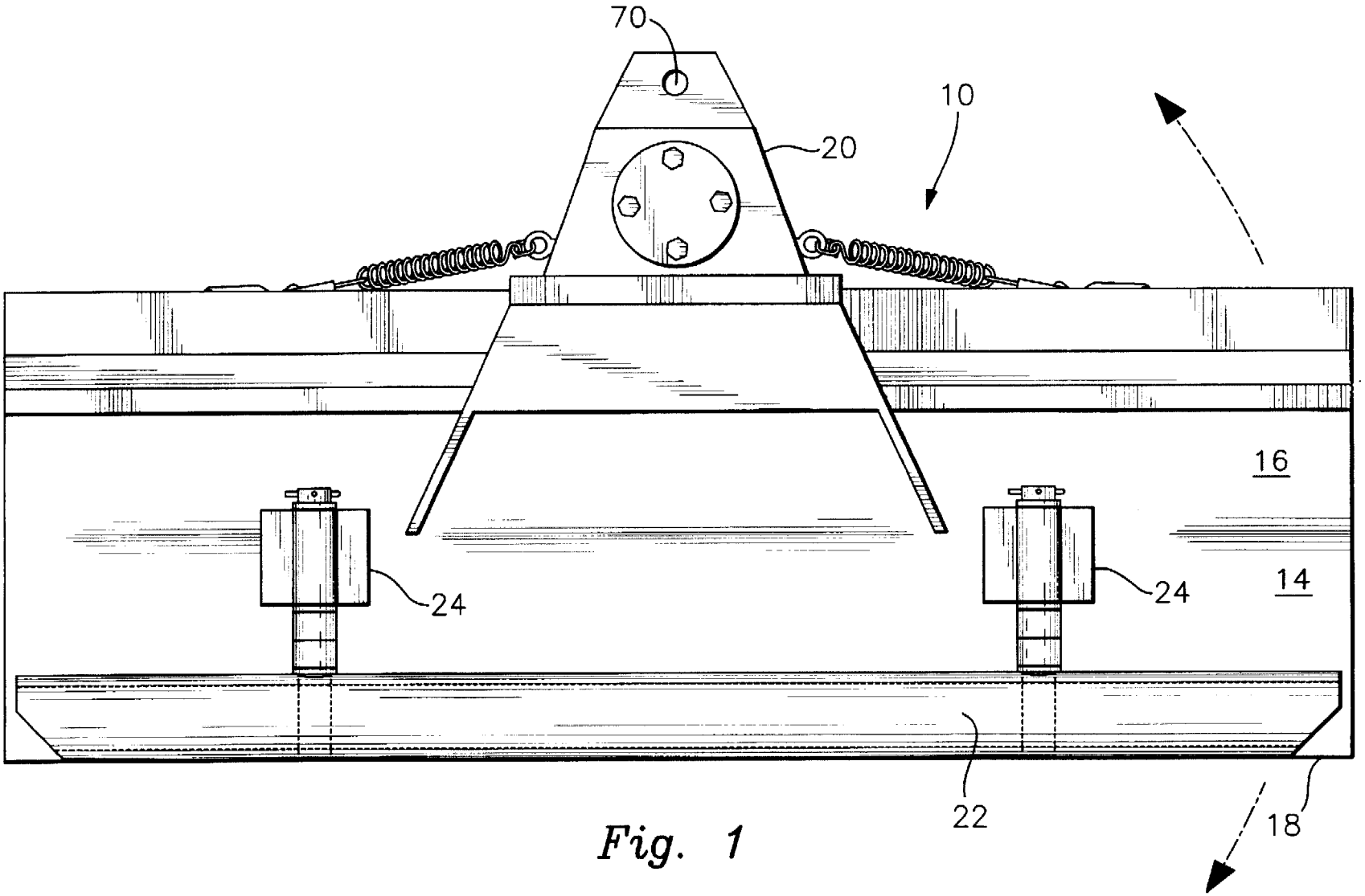
FIG. 1 is a back view of the blade showing the skid mounted to the rear of the blade.

The blades of the invention have the structure of conventional rear blades that attach to the rear of tractors in performing road working and grading operations such as snow plowing and other earth working maneuvers. Referring more specifically to the drawings, blade 10 of the invention is shown in FIGS. 1,2,3 and 7 having an inwardly curved front 12 shown in FIGS. 2 and 3 and an outwardly curved back 14 shown in FIGS. 1 and 3. Blade 10 includes the blade body 16, leading edge 18 and mainframe 20 which are conventional. Not shown are the rear of the tractor and its three point hitch, also conventional, through which the blade 10 is attached at its front through the mainframe by a corresponding three point connecting means.

Figure 8:
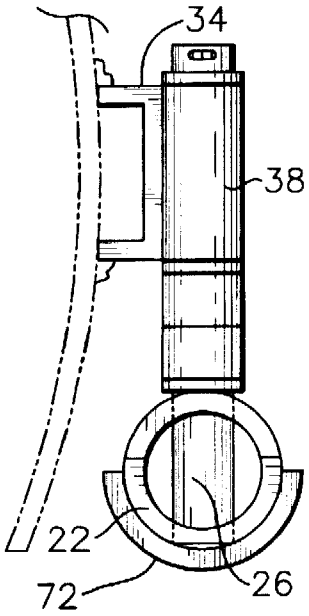
FIG. 8 is an illustration of an arcuate shaped base attached to the skid.

Shown in FIG. 1 is a back view of the blade 10 wherein the present invention skid 22 is connected horizontally to the outwardly curved back of the blade body 16 by mounting assembly 24. The skid is disposed to be borne on the ground and extends nearly the length of blade 10 about one inch lower than the adjacent leading edge 18. The skid can be constructed of any suitable durable material preferably heavy metal thick walled round pipe about four inches in diameter. The skid is capped at each end at an angle of about forty five degrees to protect its interior while the angled blade is protected from digging into the undersurface while turning. Preferably, an arcuate shaped base 72 is secured to the bottom length of the skid as seen in FIG. 8 by welding or other equivalent securing means. The arcuate shaped base 72 is preferably made of high carbon steel which protects the skid from the constant enormous pressure applied during the operation of the skid and to extend the operational life of the skid. The arcuate shaped base can be replaced after being worn down from continuous wear by another arcuate shaped, base.

Figure 3:
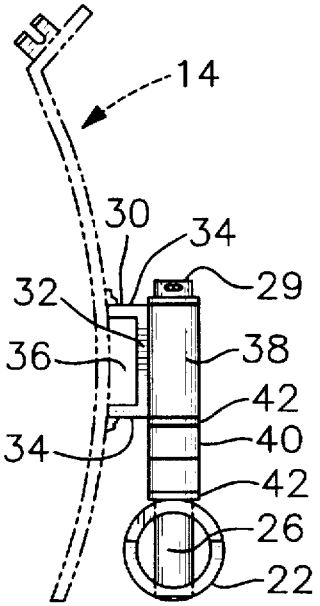
FIG. 3 is a side illustration of the mounting assembly of the skid.
Figure 4:
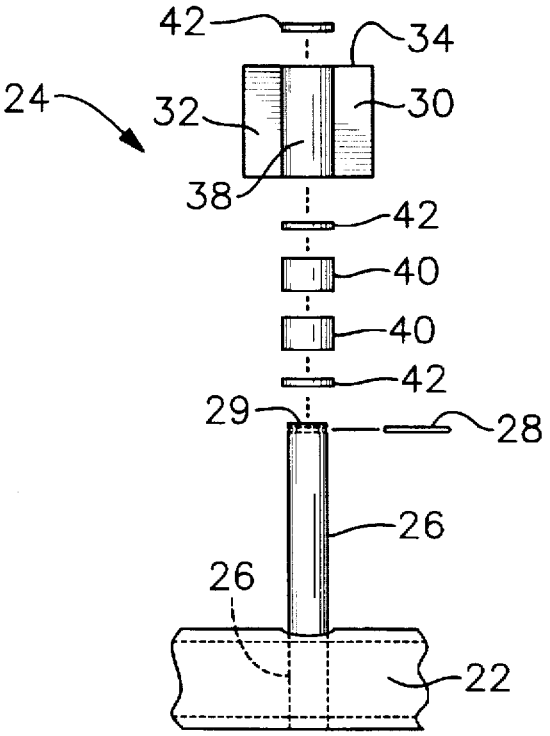
FIG. 4 is an exploded sectional illustration of the mounting assembly and the skid.

As seen in FIGS. 1,3 and 4, the skid has two spaced apart upstanding cylindrical rods 26 or similar attachment engaged within its interior which may be formed integrally, welded or otherwise secured therein. The rods are made of preferably round stock steel about one inch in diameter and each rod has a circular opening at its upper end for releasably mounting within the mounting assembly 24 by means of snap locking pin 28 through an opening 29 as shown in FIGS. 1,3 and 4.

Figure 3A:
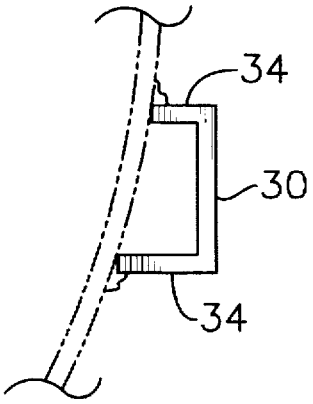
FIG. 3A is an illustration of a channel iron with different lengths of the flanges.

There are two spaced apart mounting assemblies 24 as seen in FIG. I and as individually shown in FIGS. 3 and 4. Each mounting assembly includes an inverted U-shaped channel iron 30 which includes having a flat plate 32 and flanges 34 forming a channel 36 with the flanges secured vertically to the rear of the blade such as by welding or equivalent means. Since many blades have different curvatures, the channel iron flanges can be made of different lengths as seen in FIG. 3A to accommodate the curvature and to allow the mounting assembly to provide the proper distance of the leading edge to the skid. A heavy walled pipe sleeve 38 is vertically and openly secured to the channel iron flat plate 32 by welding or other suitable means. Aligned to the top side and bottom sides of the heavy walled pipe sleeve are various combinations of cylindrical spacers 40 and washers 42. Each rod 26 supporting the skid fits within the properly combined cylindrical spacers 40 and washers 42 and heavy walled pipe sleeve 38 for axial movement therethrough and is adjustably secured therein by upper snap locking pin 28 fitted through opening 29. The proper combination of the individual spacers and washers adjusts the required height for the skid as well as providing cushioning and support for the rod. Generally, the height of the skid is set so that the leading edge 18 of the blade is held about one inch off the ground.

Figure 7A:
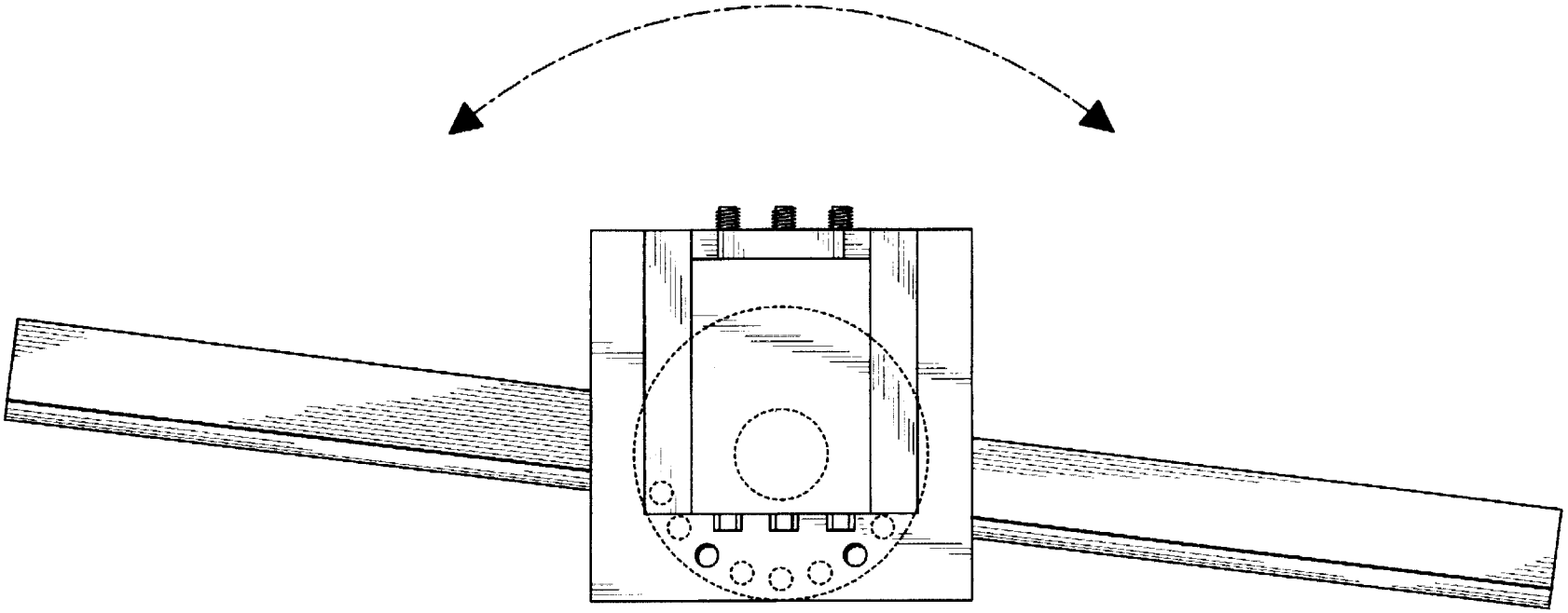
Fig. 7A Prior Art
FIG. 7A is a front view of a prior art blade with two securing pins removed.

Shown in FIG. 7A is an illustration of the top view of a prior art blade showing where two securing pins which attach to the mainframe are removed from pin holes 68 in order to rotate the blade to a new horizontal position. The blade rotates in a horizontal forward and backward direction towards and away from the tractor (not shown) as indicated by the arrows. After the securing pins are replaced, the present invention controls the new horizontal position of the blade and stabilizes and secures the required horizontal angle of the blade in order to properly grade or remove debris from the surface by modifying the present blade with stabilized springs.

Figure 2:
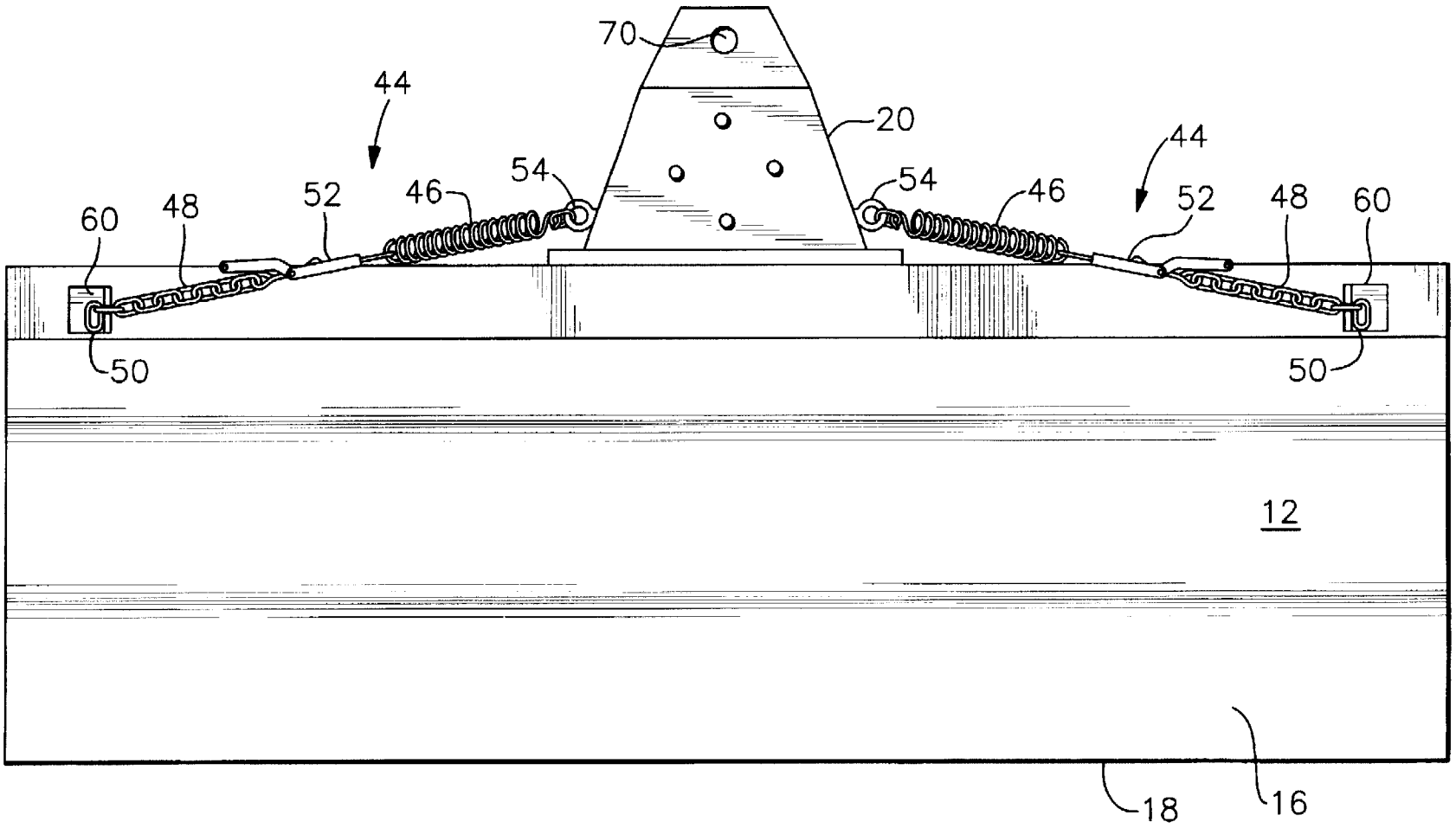
FIG. 2 is a front view of the blade showing the stabilizer springs attached to the mainframe and to the front of the blade body.
Figure 5A:
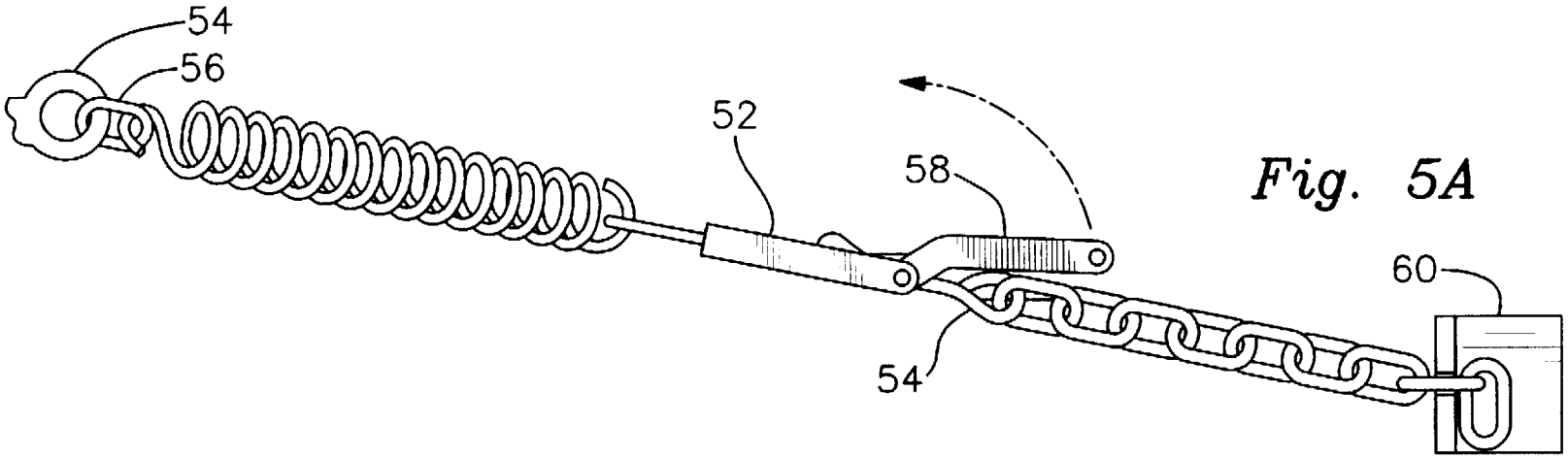
FIG. 5A is a sectional illustration of the tightener element in the locked position.
Figure 5B:
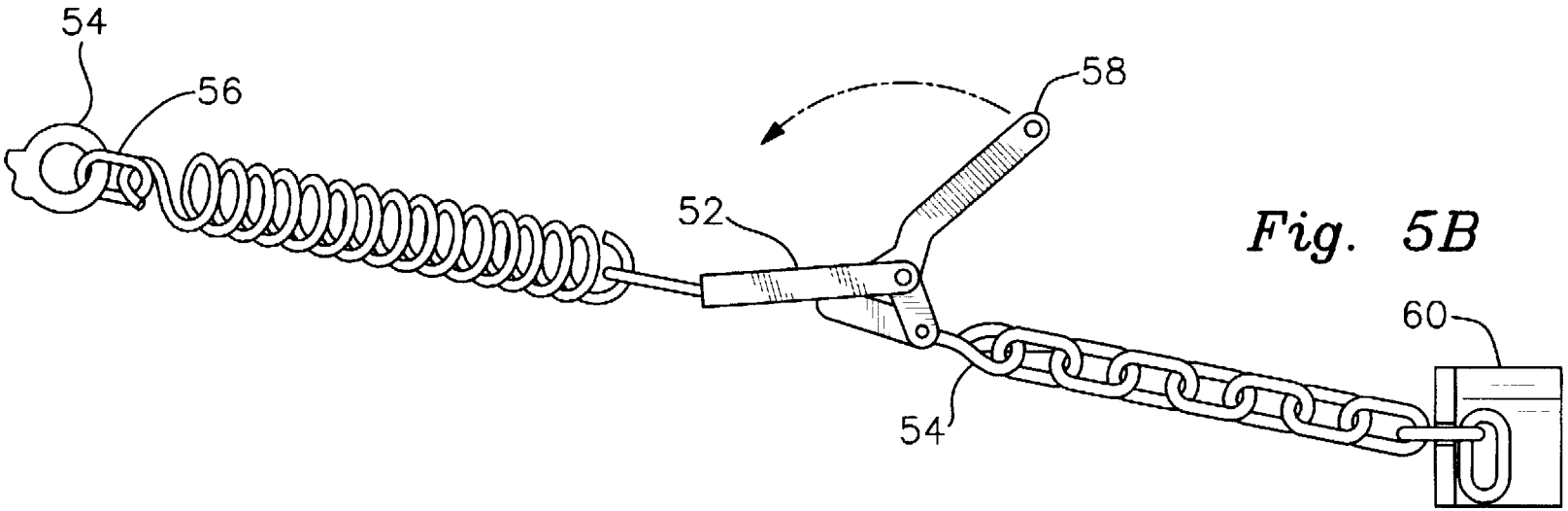
FIG. 5B is a sectional illustration of the tightener element in the loosened position.
Figure 6A:
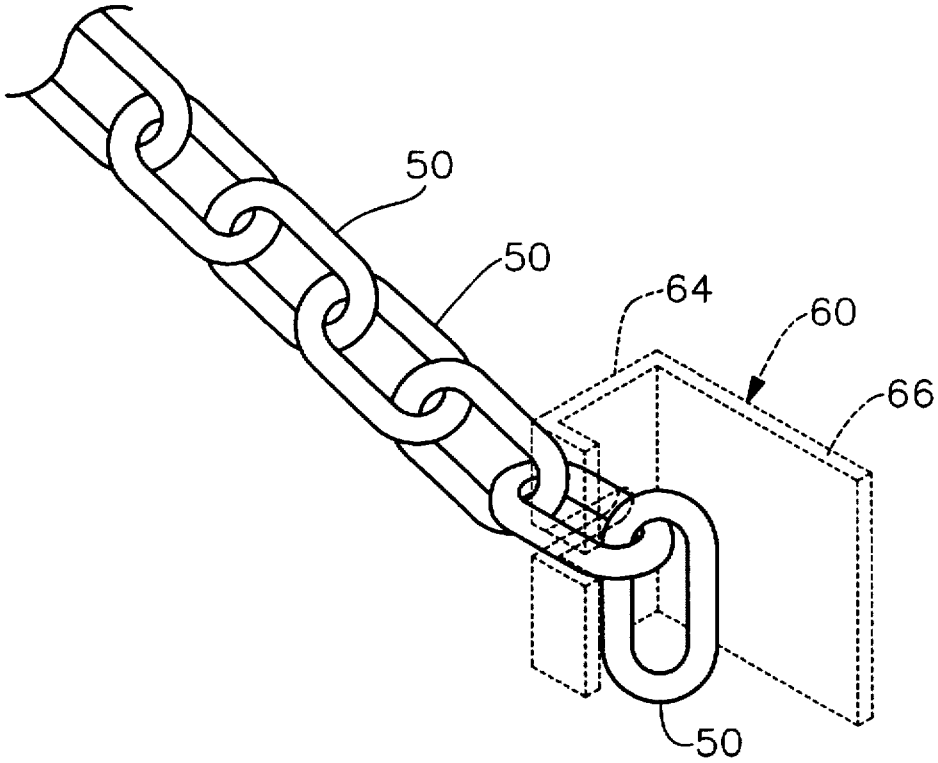
FIG. 6A is an illustration of the attachment of the link chain to the mounting bracket.
Figure 6B:
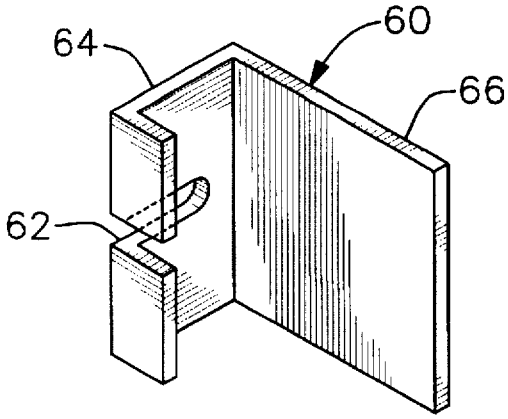
FIG. 6B is perspective view of the mounting bracket.
Figure 7B:
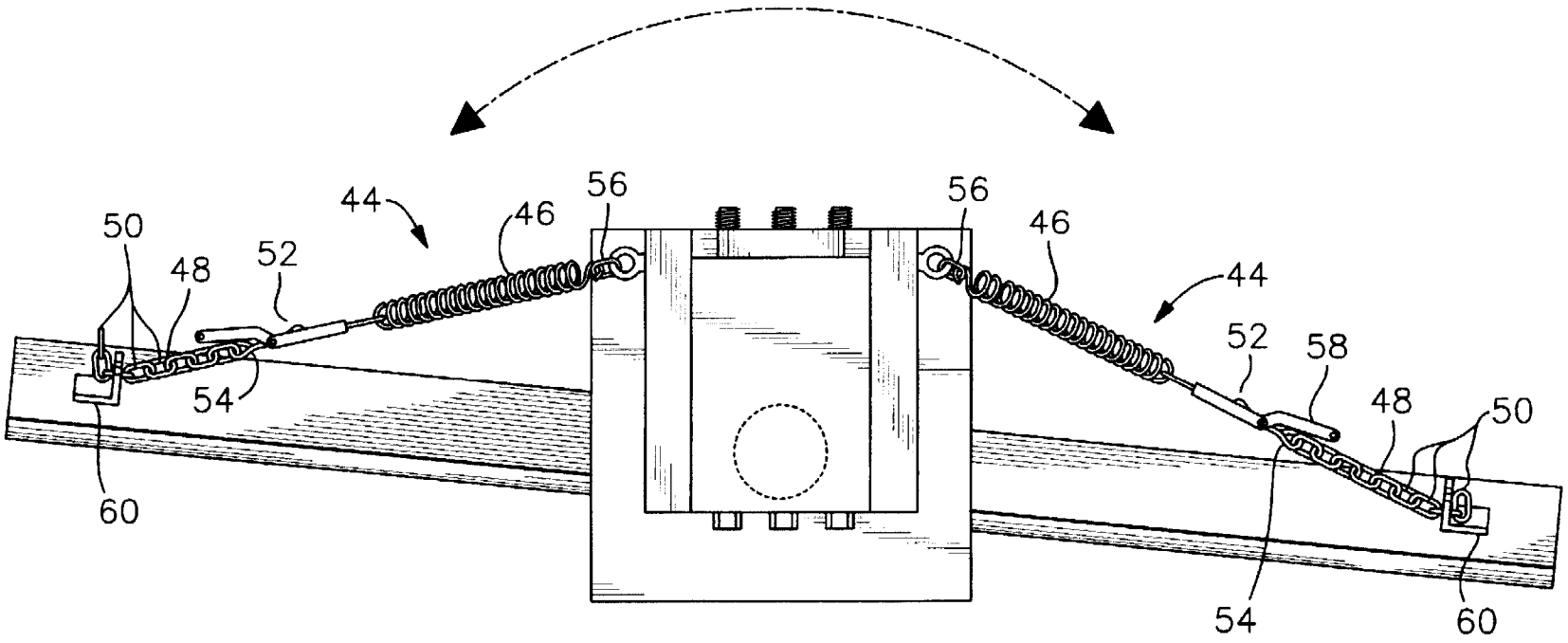
FIG. 7B is a top front view of the blade rotated on an angled grade with spring tension mechanism retaining tension with an unequal number of links on each link chain equalizing the spring tension on each stabilizer spring.

As seen in FIGS. 1 and 2, two spaced apart stabilizer springs 44 extend diagonally downwardly and are tensionally mounted to the upper inner front surface of blade body 16 and to the sides of main frame 20. Each stabilizer spring 44 includes heavy duty spring element 46 and chain link element 48 having a plurality of links 50 loosely joined together prior to being tightened. Spring element 46 and chain link element 48 are releasably and tensionally coupled together by conventional tightener element 52 or equivalent tightening device. Eye bolt 54 or similar attachment is fixed on each side pf the mainframe to which each upper end of spring element 46 is connected either to the eye bolt or as depicted in FIGS. 5A and 5B, intermediate link 56. The opposite lower end of each spring element 46 is releasably connected to the upper end of tightener element 52. Chain link element 48 is secured to the opposite lower end of tightener element 52 by an eye bolt permanently attached to the chain link element or other equivalent attachment. The lower end of chain link element 48 releasably anchors the stabilizer springs 44 to the blade body by being releasably attached to bracket 60 through notch 62 horizontally oriented right angle arm 64 extending outwardly from flat base 66 shown in FIGS. 6 and 6B. Chain link element is shortened or lengthened by manipulating the number of links 50 passing through and secured within notch 62 as seen in FIG. 7B wherein there are fewer links held in tension in the left side chain link than in the right side chain link. The flat base 66 of bracket 60 is secured to the front of the blade body by welding or other equivalent means.

The arrow in FIG. 7A illustrates a top view of prior art blade of the forward and backward horizontal rotation of the blade towards and away from the rear of the tractor when the pins have been removed from pin holes 68. Upon inserting the securing pins, stabilizer springs 44 when secured to the blade and mainframe as described, operate to apply a constant tensional restraint to this horizontal position of the blade. In adjusting the position of the blade in the rear of the tractor or other vehicle, hand lever 58 is extended to the open position as seen in FIG. 5B which loosens tightener element 52 attachments to the spring element 46 and chain link element 48 permitting the blade to be rotated to the desired present working position. The chain links 50 are then manually adjusted by dropping or adding links through notch 62 as seen in FIGS. 6 and 7B to set stabilizer springs 44 at their required lengths for holding the blade at the desired angle. Hand lever 58 is then extended to the closed position as seen in FIG. 5A which tightens chain link element 48 securing links 50 within notch 62 and applying tensional force to spring element 46. The blade can be secured at any desired angle and at equal tension by the adjusted stabilizer springs.

Figure 9:
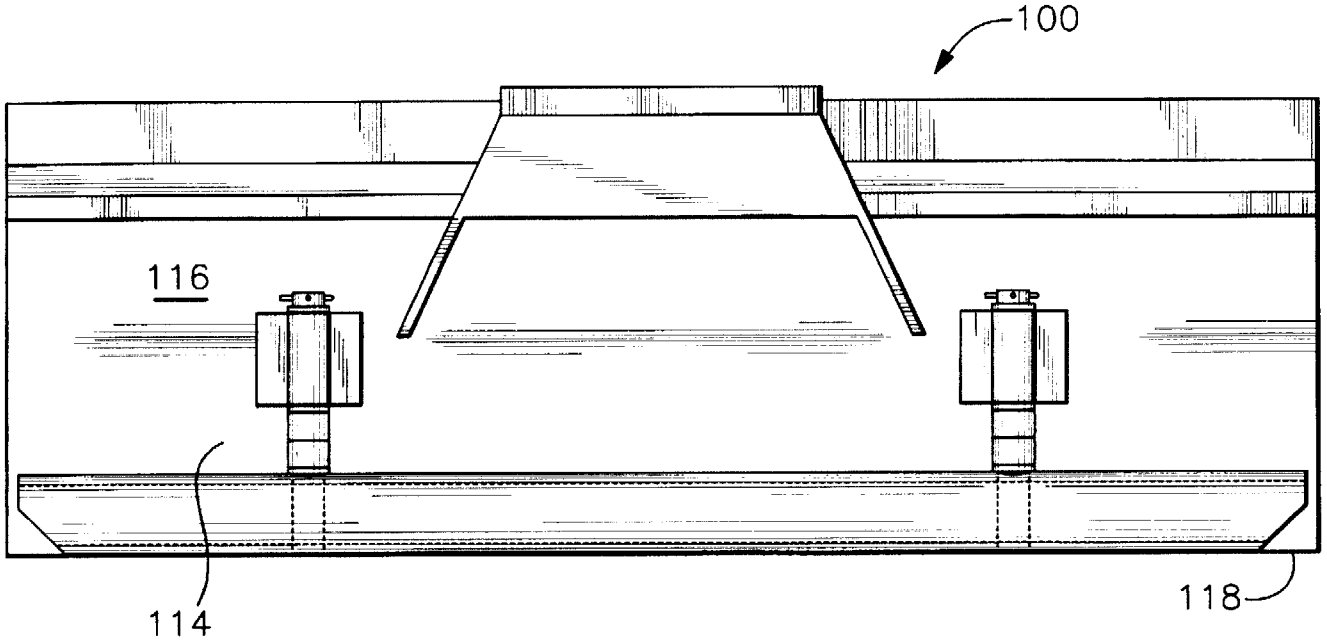
FIG. 9 is an illustration of a front blade capable of attaching to the front of a vehicle.

A second embodiment of the invention is how the skid 22 and mounting assembly 24 of the invention are applicable to front blades attached to vehicles. The front blades of the invention have the structure of conventional front blades that attach to the front of the vehicles for snow plowing or similar plowing operations. Referring to FIG. 9, front blade 100 of the invention illustrates the rear view of a conventional front blade having an outwardly curved back 114. Front blade 100 includes the front blade body 116 and leading edge 118 which are conventional. Not shown is the attachment to the front of the vehicle which is also conventional.

Illustrated in FIG. 9 is the present invention skid 22 connected horizontally to the outwardly curved back of front blade body 116 by spaced apart mounting assemblies 24. The skid 22 is disposed to be borne on the ground and extends nearly the length of front blade 100 about one inch lower than the adjacent leading edge 118. Preferably, the arcuate shaped base 72 is capable of being secured to the bottom length of the skid in the same manner as shown in FIG. 8 for the rear blade.

As illustrated in FIG. 9, skid 22 has the two spaced apart cylindrical rods 26 or similar attachments within its interior for releasably mounting within the mounting assemblies 24 by means of snap locking pin 28 through opening 29. Each mounting assembly 24 includes the U-shaped channel iron 30 having the flat plate 32 and flanges 34 forming channel 36 with the flanges secured vertically to the rear of the front blade. The heavy walled pipe sleeve 38 and cylindrical spacers 40 and washers 42 are combined in the same manner as in the rear blade.

In operation, skid 22 is secured to front blade 100 after the yoke pin has been removed allowing for forward and backward rotation of the front blade and keeping the front blade off the highs and lows of the ground. The circular structure of the skid permits the front blade to be backed-up and allows the ground to be smoothed out. The unique mounting assembly 24, channel iron 30 and rod 26 connection to the skid of the invention allows front and rear blades to be operated efficiently and smoothly not previously obtainable.

While in the specification and drawings, a general conception of a hitch adjustable blade has been described, it should be understood that various modifications can be accomplished using merely rotative engineering practices, without rising to the level of invention and without departure from the true spirit and scope of the invention.

What is claimed is:

1. A hitch adjustable blade for coupling to the front or rear of a hitchable vehicle, said blade having a length and an outwardly curved horizontal rear blade body with a bottom leading edge and capable of being tiltably secured by a yoke pin, said yoke pin being removed therefrom comprising, a pair of spaced apart mounting assemblies mounted to the rear blade body, an elongated horizontally oriented cylindrical skid releasably mounted to the mounting assemblies on the blade rear blade body adjacent the leading edge, the skid extending nearly the length of the blade.

2. A hitch adjustable blade according to claim 1 wherein each mounting assembly includes a horizontally oriented channel iron having opposing horizontal flanges secured to the rear blade body.

3. A hitch adjustable blade according to claim 2 wherein the flanges have different lengths.

4. A hitch adjustable blade according to claim 2 wherein each mounting assembly further includes a vertically mounted open sleeve mounted on the channel iron aligned with a plurality of adjacent cylindrical spacer elements and washers.

5. A hitch adjustable blade according to claim 4 wherein a pair of spaced apart vertically oriented rods secured to the skid aligned with the mounting assemblies extend upwardly through the spacer elements, washers and sleeve to releasably mount the skid to the blade.

6. A hitch adjustable blade according to claim 5 wherein the vertically mounted rod extends through an opening in the skid and is secured therein.

7. A hitch adjustable blade according to claim 6 whereby increasing the number of spacer elements and washers lowers the skid with respect to the leading edge and decreasing the number of spacer elements and washers raises the skid.

8. A hitch adjustable blade according to claim 1 wherein the cylindrical skid is secured to an arcuate shaped base.

9. A hitch adjustable blade according to claim 1 coupled to the front of a hitchable vehicle.

10. A hitch adjustable blade according to claim I for coupling to the rear of a hitchable vehicle said blade attached to a mainframe having securing pins replaced therein and further having a pair of spaced apart stabilizer spring tension mechanisms adjustably mounted to an upper surface of the blade and to the mainframe holding the blade in a tensioned angled position.

11. A hitch adjustable blade according to claim 10 wherein each spring mechanism includes a heavy duty spring element releasably and tensionally mounted on the mainframe.

12. A hitch adjustable blade according to claim 11 wherein each spring mechanism includes a chain link element having a plurality of links releasably mounted on the blade.

13. A hitch adjustable blade according to claim 12 wherein each spring mechanism includes a tightening element releasably and tensionally securing the spring element to the chain link element.

14. A hitch adjustable blade according to claim 13 wherein the chain link element is releasably mounted to a mounting bracket secured to the blade.

15. A hitch adjustable blade according to claim 14 wherein the chain link element is decreased in length by shortening the number of links secured to the blade.

* * * * *